US006131742A

United States Patent [19]

Selin

[11] Patent Number: 6,131,742

[45] Date of Patent: Oct. 17, 2000

[54] DEVICE FOR SEPARATING CONTAMINANTS FROM FIBRE PULP SUSPENSIONS

[75] Inventor: Roland Selin, Bromma, Sweden

[73] Assignee: GL&V/Celleco AB, Stockholm, Sweden

[21] Appl. No.: 09/171,977

[22] PCT Filed: Apr. 28, 1997

[86] PCT No.: PCT/SE97/00711

§ 371 Date: Oct. 29, 1998

§ 102(e) Date: Oct. 29, 1998

[87] PCT Pub. No.: WO97/41296

PCT Pub. Date: Nov. 6, 1997

[30] Foreign Application Priority Data

May 2, 1996 [SE] Sweden ..... 9601670

[51] Int. Cl.[7] ..... B07B 1/20; B07B 1/06; B03B 7/00

[52] U.S. Cl. ..... 209/306; 209/17; 209/283

[58] Field of Search ..... 209/17, 273, 281, 209/283, 284, 300, 305, 306

[56] References Cited

U.S. PATENT DOCUMENTS 5,078,859 1/1992 Satomi .

FOREIGN PATENT DOCUMENTS 0 473 354 3/1992 European Pat. Off. .
7506163-0 11/1980 Sweden .
7910465-9 2/1985 Sweden .

*Primary Examiner*—Robert P. Olszewski
*Assistant Examiner*—Brett C Martin
*Attorney, Agent, or Firm*—Browdy and Neimark

[57] ABSTRACT

A separation device for separating contaminants from fiber pulp suspensions, preferably produced from waste paper, comprises a cylindrical screen number (4) and a rotor (7) arranged therein. An annular inlet passage (14) for incoming suspension surrounds a tubular wall (11), which extends from the screen member (4) coaxially with the rotor (7). According to the invention, a flow deflecting wall member (16) extends toward the rotor (7) to a position in which the wall member is axially in front of an open end (12) of the tubular wall (11) and radially inside the tubular wall. Furthermore, the wall member (16) with a cross-sectional area which is substantially less than the cross-sectional area of the annular inlet passage (14).

9 Claims, 1 Drawing Sheet

DEVICE FOR SEPARATING CONTAMINANTS FROM FIBRE PULP SUSPENSIONS

Figure 1:
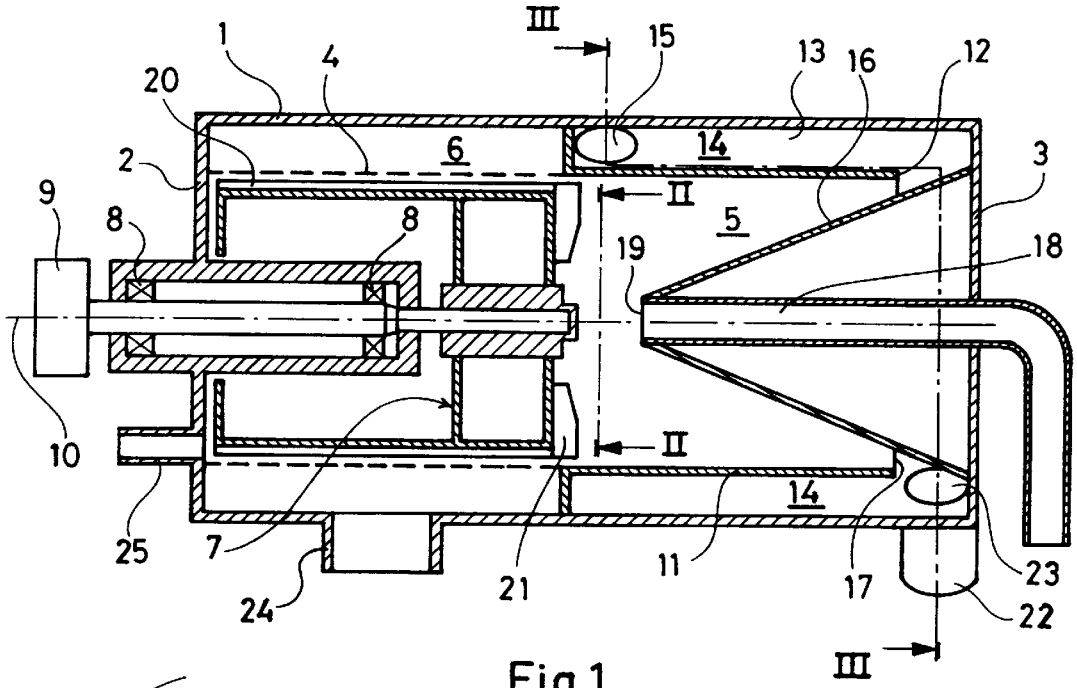

The present invention relates to a device for separating contaminants from a fibre pulp suspension, comprising a hollow housing with two opposite side walls, a substantially cylindrical screen member extending in the interior of the housing from one of the side walls towards the other side wall and dividing the interior of the housing into a first chamber for suspension to be screened by means of the screen member and a second chamber for receiving screened suspension. The device further comprises a rotor in the screen member arranged rotatable about an axis which is coaxial with the screen member, and a tubular wall extending in the first chamber from the screen member substantially coaxially with the axis of the rotor towards the other side wall to an open end of the tubular wall situated at a distance from the other side wall. The first chamber has a substantially cylindrical circumference surface extending axially along the tubular wall to the other wall and which is coaxial with the axis of the rotor, whereby an annular inlet passage is formed between said circumference surface and the tubular wall. There are an inlet member for suspension to be separated arranged to conduct the suspension into the inlet passage, a first outlet member adapted to catch relatively large and heavy contaminants moving along said circumference surface in the inlet passage, a second outlet member for discharging screened suspension from the second chamber, and a third outlet member for discharging contaminants from the interior of the screen member.

A separation device of this kind is known from U.S. Pat. No. 4,234,417 and is preferably used for separating relatively coarse contaminants from pulp suspensions. In certain kinds of heavily polluted pulp suspensions, especially such suspensions which are produced from waste paper, there may be very coarse contaminants, such as metal scrap and gravel, which may damage the screen member rotor of the known device. Such very coarse contaminants are therefore separated from the pulp suspension with the aid of a separation stage comprising hydrocyclones, before the pulp suspension is supplied to the known device. The fibre concentration of the pulp suspension is kept at about 0.5% to about 1%, in order to achieve a well functioning hydrocyclone separation. The separation efficiency and capacity of the known device on the other hand is best if the fibre concentration of the pulp suspension is from about 3.5% to about 5%. The fibre concentration of the pulp suspension which leaves the hydrocyclone stage of course may be increased to a suitable concentration with the aid of a dewatering device before the pulp suspension is supplied to the known device. However, this would result in significant increases of costs, and consequently the pulp suspension usually is supplied to the known device directly from the hydrocyclone stage without a preceding dewatering, in spite of the fact that the known device as a result thereof can not function optimally.

The object of the present invention is to provide an improved separation device of the kind here presented with respect to separation of such very coarse contaminants which normally is performed by hydrocyclones.

This object is obtained by means of a device of the kind initially described, which is characterized in that a low deflecting wall member extends from the other side wall towards the rotor to a position in which the wall member is axially substantially in front of the open end of the tubular wall and radially inside the tubular wall, and that the wall member is arranged such that an annular flow passage is formed between the tubular wall and the wall member with a cross-sectional area which is substantially smaller than the cross-sectional area of said annular inlet passage. Hereby the flow velocity of the suspension in the inlet passage will be substantially less than the flow velocity of the suspension through said annular flow passage, which results in that very coarse contaminants entering the inlet passage are efficiently catched by the first outlet member, since the entraining forces which the slowly flowing suspension exerts on the coarse contaminants will be relatively weak. Because of this improved efficiency of the device according to the invention with regard to its ability to remove very coarse contaminants, there is no need for the above described hydrocyclone stage. This in turn results in the advantage that the fibre concentration of the pulp suspension to be separated can be increased to between 3.5% and 5%, which increases the separation efficiency and capacity of the device according to the invention.

Since the rotor normally comprises a cylindrical mantle surface which is coaxial with the axis of the rotor and which extends axially along the screen member, said annular flow passage is suitably dimensioned with a breadth in radial direction which is smaller than the radial distance between the screen member and the mantle surface of the rotor. This results in that the containants which can pass through said annular flow passage an not be stucked between the rotor and the screen member, whereby damages on the rotor and the screen member are avoided.

According to a preferred embodiment of the invention the inlet member is adapted to conduct the suspension to be separated substantially tangentially into the annular inlet passage at that end of the tubular wall which is opposite said open end, and the first outlet member forms a passage having an inlet opening in the lower part of the inlet passage at said other side wall. Hereby coarse, heavy contaminants will be accumulated in the lower part of the inlet passage due to gravity and be entrained by the resulted slow helical suspension flow axially along the inlet passage until the contaminants are catched by the first outlet member.

Said inlet opening in the inlet passage is suitably situated close to said other side wall.

The wall member is preferably extending into the interior of the tubular wall and forms an outlet passage for relatively light contaminants, which outlet passage extends from the first chamber through the wall member to the outside of the housing, the outlet passage having an inlet opening located centrally in the interior of the tubular wall. Since the suspension flow accelerates when it flows helically into the annular flow passage, a vortex is created in which light contaminants are separated radially inwardly. These separated light contaminants can be fed out through the outlet passage of the wall member. The radial extension of the wall member in the tubular wall is advantageously decreasing in direction towards the rotor. For instance, the wall member may have a conical portion with a vortex end, in which said inlet opening is located.

The rotor is suitably provided with shovel members, which extend axially from the rotor at least partly into the interior of the tubular wall, in order to increase the rotational speed of the vortex close to the rotor. In addition, the shovel members break up possibly existing flakes of fibres into single fibres, whereby the fibre yield is improved. It is also advantageous that the suspension has about the same peripheral velocity as the rotor when the suspension flows in between the rotor and the screen member.

Figure 2:
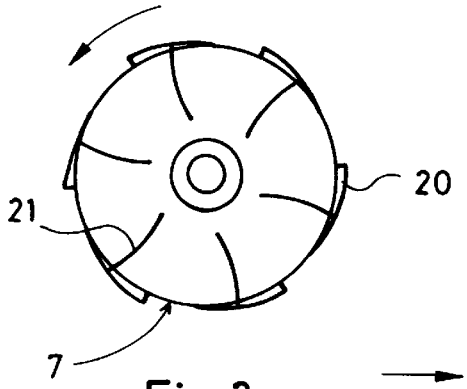
Figure 3:
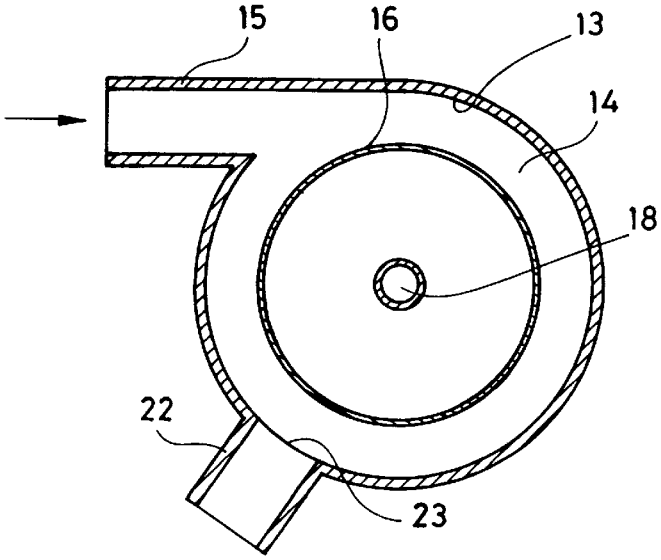

The invention is described in more detail in the following with reference to the accompanying drawing, in which FIG. 1 shows a view of a longitudinal section through a device according to the invention, FIG. 2 shows a view of a section along the line II—II in FIG. 1, and FIG. 3 shows a section along the line III—III in FIG. 1.

In FIG. 1 there is shown a device according to the invention comprising a hollow cylindrical housing 1 with two opposite vertical side walls 2, 3. A stationary circular cylindrical screen member 4 extends in the interior of the housing 1 coaxially with the housing 1 from one of the side walls 2 toward the other side wall 3 along about half the length of the housing 1 and divides the interior of the housing 1 into a chamber 5 for suspension to be screened by means of the screen member 4 and an annular chamber 6 for receiving screened suspension. A rotor 7 with substantially circular cross section is journalled in the housing 1 by means of a bearing 8 and extends in the interior of the cylindrical screen member 4, the rotor 7 being rotatable by a drive motor 9 about an axis 10 which is coaxial with the screen member 4.

A circular cylindrical wall 11 with about the same diameter as the screen member 4 extends from the latter in the chamber 5 coaxially with the axis 10 towards the side wall 3, the wall 11 having an open end 12 which is located close to but at a distance from the side wall 3. The chamber 5 has a cylindrical circumference surface 13 extending axially along the wall 11 coaxially with the axis 10, whereby an annular inlet passage 14 is formed between the circumference surface 13 and the wall 11. An inlet member 15 for the suspension to be separated is arranged to conduct the suspension substantially tangentially into the inlet passage 14 at that end of the wall 11 which is opposite to the open end 12 of the wall 11.

A flow deflecting conical wall member 16 extends from the side wall 3, at which the base of the wall member 16 is located, towards the rotor 7 into the interior of the cylindrical wall 11, the cone apex of the wall member 16 being located centrally in the interior of the wall 11 but at a distance from the rotor 7. The wall member 16 is arranged such that an annular flow passage 17 is formed between the cylindrical wall 11 and the conical wall member 16 with a cross-sectional area which is substantially smaller than the cross-sectional area of the inlet passage 14 and with a breadth in radial direction which is less than the radial distance between the screen member 4 and the mantle surface of the rotor 7. An outlet passage 18 for relatively light contaminants extends centrally through the conical wall member 16 to the outside of the housing 1, the outlet passage 18 having an inlet opening 19, which is located at the apex of the conical wall member 16.

The rotor 7 is provided with six rotor blades 20, which extend axially along the mantle surface of the rotor 7 and radially a distance outwardly from the latter. The purpose of the rotor blades 20 is to prevent clogging of the screen holes of the screen member 4 and to maintain a flow of suspension in the circumferential direction of the screen member 4. The rotor 7 is also provided with six shovel blades 21, which are arranged on that axial end of the rotor 7 which faces the wall member 16. Each shovel blade 21 extends substantially radially along the rotor 7 and axially a distance into the interior of the cylindrical wall 11.

An outlet member 22 for catching coarse and heavy contaminants forms a passage with an inlet opening 23 in the lower part of the inlet passage 14 close to the side wall 3. Normally the outlet member 22 is provided with a sluice device (not shown), in order to enable intermittent emptying of catched contaminants.

The housing 1 is provided with an outlet member 24 for discharging screened suspension from the lower part of the chamber 6 and with an outlet member 25 in the side wall 2 for discharging separated contaminants from the inside of the screen member 4.

The device according to FIG. 1 is operated in the following manner. The fibre suspension to be separated is first produced from waste paper in a pulper and is mixed with water to a suitable fibre concentration between 3.5 and 5%. The produced fibre suspension is pumped via the inlet member 15 into the inlet passage 14, in which the suspension flows helically with a relatively low axial velocity in direction towards the side wall 3. During the flow of the suspension in the inlet passage 14 existing coarse heavy contaminants are accumulated, such as metal fragments and gravel, by gravity in the lower part of the inlet passage 14, where the contaminants are entrained by the suspension in direction towards the side wall 3 until they are catched by the outlet member 22. Also such relatively heavy contaminants which rotate with the suspension along the circumference surface 13 of the chamber 5 are finally catched by the outlet member 22.

At the side wall 3 the suspension flow is deflected by the wall member 16 in direction towards the rotor 7 and accelerates through the relatively narrow annular flow passage 17, whereby a vortex of the suspension is created in the interior of the cylindrical wall which separates existing light contaminants, such as plastic fragments, radially inwardly in the vortex. The separated light contaminants move along the conical surface of the wall member 16 to the cone apex of the wall member 16 where the light contaminants are pushed through the inlet opening 19 and pass further out from the device via the outlet passage 18. If required, the outlet passage 18 may be connected to an underpressure source in order to promote the removal of light contaminants.

The rotational speed of said suspension vortex close to the rotor 7 is maintained with the aid of the shovel blades 21, which also disintegrate existing fibre flocks into single fibres. The suspension which now is free from very coarse and heavy contaminants and also is substantially free from relatively light contaminants, thereafter flow helically in between the rotor 7 and the screen member 4, and is screened by the screen member 4. The screened suspension, which now is free from normal size coarse contaminants, is collected in the chamber 6 and is emptied from the latter via the outlet member 24. The contaminants trapped on the inside of the screen member 4 proceed axially along the screen member 4 and finally pass out from the device via the outlet member 25.

It has been proved that the above described embodiment of the device according to the invention is capable of separating fibre suspensions, which have fibre concentrations between 3.5 and 5%, with an efficiency of between 90 and 96% with regard to separation of relatively coarse heavy contaminants. The reject flow, i.e. the flow containing the contaminants which are separated by the screen member 4 and which is discharged through the outlet member 25, may at this high efficiency still be kept as low as 5 to 10% of the total suspension flow. As a comparison it may be mentioned that a conventional separation device of the kind here presented requires a reject flow of between 15 and 20% in order to reach an efficiency of 90%, with regard to separation of coarse contaminants from a fibre suspension, the fibre concentration of which normally is betweeen 0.5 and 1%. Thus, the device according the invention has a higher separation efficiency and capacity compared to the corresponding conventional separation devices intended for separation of coarse contaminants from fibre suspensions produced from waste paper.

What is claimed is:

1. A device for separating contaminants from a fibre pulp suspension, comprising a hollow housing (1) with two opposite side walls (2,3), a substantially cylindrical screen member (4) extending in the interior of the housing from one of the side walls towards the other side wall and dividing the interior of the housing into a first chamber (5) for suspension to be screened by means of the screen member and a second chamber (6) for receiving screened suspension, a rotor (7) in the screen member arranged rotatable about an axis (10) which is coaxial with the screen member, a tubular wall (11) extending in the first chamber from the screen member substantially coaxially with the axis of the rotor towards the other side wall to an open end (12) of the tubular wall which is located at a distance from the other side wall, the first chamber having a substantially cylindrical circumference surface (13) extending axially along the tubular wall to the other wall and which is coaxial with the axis of the rotor, whereby an annular inlet passage (14) is formed between said circumference surface and the tubular wall, an inlet member (15) for suspension to be separated arranged to conduct the suspension into the inlet passage, a first outlet member (22) adapted to catch relatively large and heavy contaminants moving along said circumference surface in the inlet passage, a second outlet member (24) for discharging screened suspension from the second chamber, and a third outlet member (25) for discharging contaminants from the interior of the screen member, characterized in that a flow deflecting wall member (16) extends from the other side wall (3) towards the rotor (7) to a position in which the wall member is axially substantially in front of the open end (12) of the tubular wall (11) and radially inside the tubular wall, and that the wall member is arranged such that an annular flow passage (17) is formed between the tubular wall and the wall member with a cross-sectional area which is substantially smaller than the cross-sectional area of said annular inlet passage (14), the rotor (7) comprising a cylindrical mantle surface, which is coaxial with the axis (10) of the rotor and which extends axially along the screen member (4), and the annular flow passage (17) having a breadth in radial direction which is less than the radial distance between the screen member and the mantle surface of the rotor.

2. A device according to claim 1, characterized in that the flow deflecting wall member (16) extends into the interior of the tubular wall (11).

3. A device according to claim 2, characterized in that an outlet passage (18) for relatively light contaminants extends from the first chamber (5) through the wall member (16) to the outside of the housing, the outlet passage having an inlet opening (19) which is located centrally in the interior of the tubular wall (11).

4. A device according to claim 3, characterized in that the radial extension of the wall member (16) in the tubular wall (11) decreases in direction towards the rotor.

5. A device according to claim 4, characterized in that the wall member (16) has a conical portion with an apex end in which said inlet opening (19) is located.

6. A device according to claim 1, characterized in that the rotor (7) is provided with radial shovel members (21), which extend axially from the rotor at least partly into the interior of the tubular wall (11).

7. A device according to claim 1, characterized in that the inlet member (15) is adapted to conduct the suspension to be separated substantially tangentially into the annular inlet passage (14) at the end of the tubular wall (11) which is opposite to said open end (12), and that the first outlet member (22) forms a passage which has an inlet opening (23) in the lower part of the inlet passage at said other side wall (3).

8. A device according to any one of claim 1, characterized in that said inlet opening (23) is located close to said other side wall (3).

9. A device according to any one of claim 1, characterized in that the circumference surface (13) of the first chamber (5), the tubular wall (11) and the flow deflecting wall member (16) have circular cross-sections.

* * * * *